US007866863B2

(12) United States Patent
Tanaka

(10) Patent No.: US 7,866,863 B2
(45) Date of Patent: Jan. 11, 2011

(54) VEHICLE LAMP

(75) Inventor: Hidetada Tanaka, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 264 days.

(21) Appl. No.: 12/013,987

(22) Filed: Jan. 14, 2008

(65) Prior Publication Data

US 2008/0170408 A1 Jul. 17, 2008

(30) Foreign Application Priority Data

Jan. 15, 2007 (JP) ..... 2007-005394

(51) Int. Cl.
*F21V 7/00* (2006.01)

(52) U.S. Cl. ..... 362/518; 362/516; 362/517; 362/297; 362/296.05

(58) Field of Classification Search ..... 362/516–519, 362/297, 346, 538–539, 298–303, 217.05–217.07, 362/296.01, 296.05–296.08, 341, 350
See application file for complete search history.

(56) References Cited

U.S. PATENT DOCUMENTS 4,964,021 A * 10/1990 Masin ..... 362/538
7,125,150 B2 * 10/2006 Brun et al. ..... 362/517

FOREIGN PATENT DOCUMENTS

DE 100 61 284 A1 6/2001
DE 600 36 655 T2 7/2008
JP 9-22607 A 1/1997
JP 2000-276916 A 10/2000

OTHER PUBLICATIONS

Patent Abstracts of Japan, Publication No. 09-022607, Publication Date: Jan. 21, 1997, 2 pages.
Patent Abstracts of Japan, Publication No. 2000-276916, Publication Date: Oct. 6, 2000, 2 pages.
English abstract of DE10061284 published on Jun. 21, 2001, esp@cenet databse, 1 page.
English abstract of DE60036655 published on Jul. 3, 2008, esp@cenet databse, 1 page.
Office Action for German Application No. 10 2008 003 933.0-54 dated Jun. 24, 2009 and English translation thereof, 8 pages.

* cited by examiner

*Primary Examiner*—Jong-Suk (James) Lee
*Assistant Examiner*—Robert J May
(74) *Attorney, Agent, or Firm*—Osha • Liang LLP

(57) ABSTRACT

A vehicle headlamp has a segment light source, and a reflector configured to forward reflect light from the segment light source. The segment light source is arranged such that a first predetermined point located at a front end edge of the segment light source is located on a first reference axis. A reflecting surface of the reflector is split into a plurality of reflection regions. At least one of the plurality of reflection regions is constituted as a fan-like reflection region surrounded by a first straight line extending obliquely downward from the first reference axis, and a second straight line extending immediately downward from the first reference axis. The fan-like reflection region is constituted with a curved surface that deflects, diffuses, or reflects the light from the segment light source in a direction orthogonal to the first straight line.

20 Claims, 6 Drawing Sheets

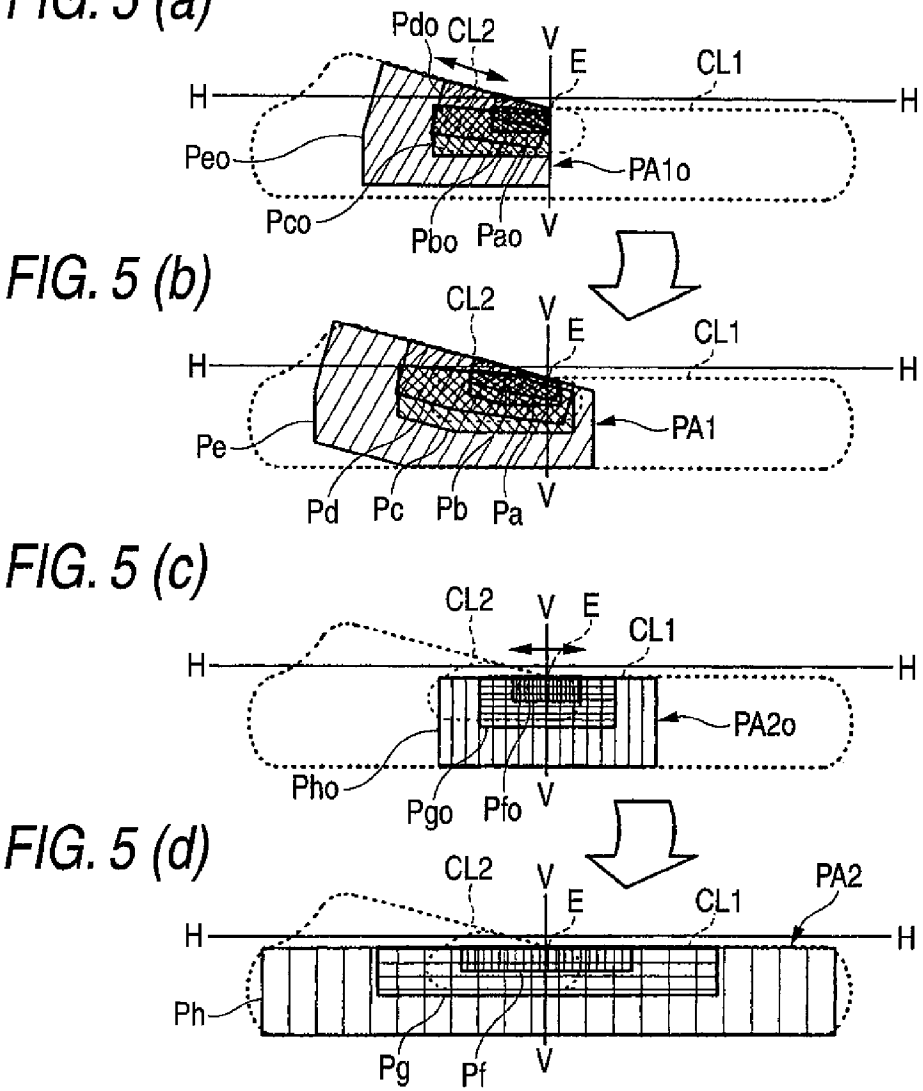
FIG. 5 (a)
FIG. 5 (b)
FIG. 5 (c)
FIG. 5 (d)
H
V
E
CL1
CL2
PA1o
PA1
PA2o
PA2
Pdo
Peo
Pco
Pbo
Pao
Pe
Pd
Pc
Pb
Pa
Pho
Pgo
Pfo
Ph
Pg
Pf
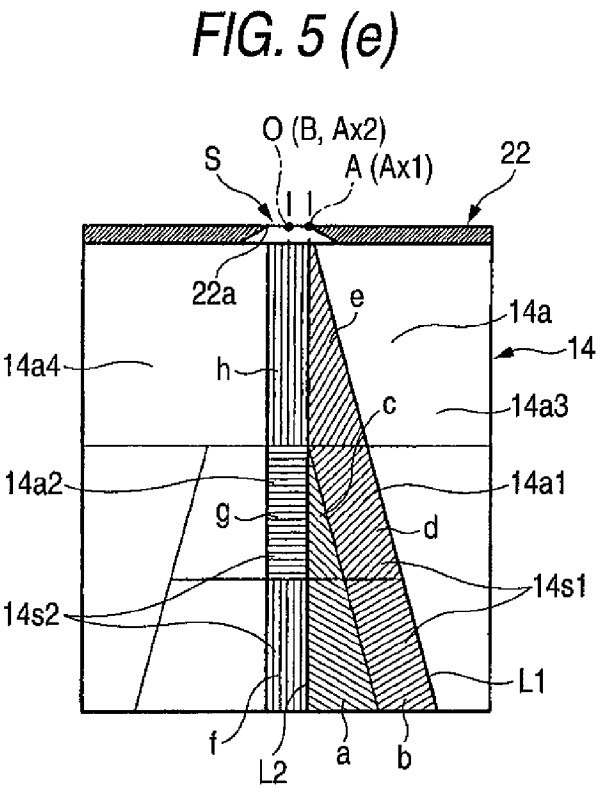
FIG. 5 (e)
22
14
14a
14a3
14a1
14s1
L1
O (B, Ax2)
A (Ax1)
S
22a
e
c
d
b
a
L2
f
h
g
14a4
14a2
14s2

VEHICLE LAMP

This application claims foreign priority from Japanese Patent Application No. 2007-005394 filed on Jan. 15, 2007, the entire contents of which are hereby incorporated by reference.

BACKGROUND OF THE INVENTION

1. Field of the Invention

The present invention relates to a vehicle headlamp comprising a reflector configured to forward reflect the light from a segment light source extending in a vehicle width direction such that a light distribution pattern is formed that has a cut-off line at an upper end thereof.

Background Art

2. Related Art

Conventionally, as a vehicle headlamp, headlamps having reflectors that forward reflect the light from a segment light source extending in a vehicle width direction such that a light distribution pattern is formed that has a cut-off line at an upper end thereof are known.

In typical cases, a vehicle headlamp is configured to split the reflecting surface of a reflector into a plurality of reflection regions. Each of the reflection regions is configured with a predetermined curved surface. The predetermined curved surfaces are formed with a paraboloid of revolution that uses the middle position of the segment light source in right and left directions as a focal point formed as a reference plane such that a light distribution pattern is formed that has a cut-off line at an upper end thereof is described in "Patent Document 1."

Further, as described in "Patent Document 2," a vehicle headlamp has been configured to arrange a segment light source in a first focal point of an ellipsoid of revolution in a first reflector that has a reflecting surface including the ellipsoid of revolution, and arrange a shade in a second focal point of the ellipsoid of revolution. Thus, a portion of the light from the segment light source reflected by the first reflector is shielded by means of the shade and the shielded light is forward reflected by means of a second reflector such that a light distribution pattern is formed that has a cut-off line at an upper end thereof.

Patent Document 1: JP-A-09-022607

Patent Document 2: JP-A-2000-276916

By configuring the reflector of a vehicle headlamp to forward reflect the light from the segment light source extending in the vehicle width direction as described above, it is possible to enhance the use efficiency of luminous fluxes even if the right-and-left width of the reflector is narrow.

However, the vehicle headlamp described in the above "Patent Document 1" has problems in that it is not easy to clearly form an oblique cut-off line that rises obliquely with respect to the horizontal direction because the reflecting surface of the reflector is constituted with a curved surface that is formed with a paraboloid of revolution that uses the middle position of the segment light source in the right and left directions as a focal point formed as a reference plane.

On the other hand, the vehicle headlamp described in the above "Patent Document 2" has problems in that it is possible to clearly form an oblique cut-off line, but it is not easy to make the luminous intensity distribution of a light distribution pattern just below the oblique cut-off line as desired because the cut-off line is formed as an inverted projection image of the shade.

SUMMARY OF THE INVENTION

One or more embodiments of the invention provide a vehicle headlamp capable of clearly forming an oblique cut-off line and making the luminous intensity distribution of a light distribution pattern just below the oblique cut-off line as desired, in a headlamp comprising a reflector configured to forward reflect the light from a segment light source extending in a vehicle width direction such that a light distribution pattern is formed that has a cut-off line at an upper end thereof.

A vehicle headlamp according to one or more embodiments of the invention comprises a reflector configured to forward reflect the light from a segment light source extending in a vehicle width direction such that a light distribution pattern is formed that has a cut-off line at an upper end thereof. The segment light source is arranged such that a first predetermined point located at a front end edge of the segment light source at end edges thereof in right and left directions in a plan view of the lamp is arranged so as to be located on a first reference axis extending in the longitudinal direction of a vehicle. A reflecting surface of the reflector is split into a plurality of reflection regions. At least one of the plurality of reflection regions, in the plan view of the lamp, are constituted as a fan-like reflection region surrounded by a first straight line extending obliquely downward from the first reference axis on the side of the first reference axis opposite the segment light source in the right and left directions, and a second straight line extending immediately downward from the first reference axis. The fan-like reflection region is constituted with a curved surface that deflects, diffuses, or reflects the light from the segment light source in a direction orthogonal to the first straight line, with a paraboloid of revolution that uses the first predetermined point as a focal point, and uses the first reference axis as a center axis formed as a reference plane, and is configured so as to form the oblique cut-off line that rises obliquely with respect to the horizontal direction by the deflected, diffused, or reflected light from the fan-like reflection region.

One or more embodiments of the "vehicle headlamp" may have a configuration including reflectors other than the above reflector, and may have a configuration that does not include the above reflector.

In one or more embodiments, the "segment light source" is not particularly limited in terms of specific configuration, so long as it extends in the vehicle width direction. For example, it is possible to adopt a discharge light-emitting portion of a discharge bulb, a filament of a halogen bulb, or a plurality of light-emitting chips in a light-emitting diode having the plurality of light-emitting chips that are arranged in a row. Moreover, it is possible to constitute the "segment light source" not with an actual light source, but with a pseudo-light source in the form of a segment light source.

Although the "reflecting surface of a reflector" is split into a plurality of reflection regions, the concrete number or shape of the split regions, or the concrete shape of the reflecting surface of each reflection region is not particularly limited, so long as the fan-like reflection region is included in some of the plurality of reflection regions. Further, in one or more embodiments, the "fan-like reflection region" itself may be constituted with a single reflection region, and may be split into a plurality of small reflection regions.

In one or more embodiments, the "first straight line" is not limited in terms of its opening angle with respect of the second straight line, so long as it is a straight line extending obliquely downward from the first reference axis. For example, the opening angle can be set to a value within the range of about 10 to 45°.

In the present specification, the "deflection or diffusion" means any one of only deflection, only diffusion, and a combination of deflection and diffusion.

The vehicle headlamp according to one or more embodiments of the invention comprises a reflector configured to forward reflect the light from a segment light source extending in a vehicle width direction such that a light distribution pattern is formed that has a cut-off line at an upper end thereof. The segment light source is arranged such that a first predetermined point located at a front end edge of the segment light source at end edges thereof in right and left directions in a plan view of the lamp is arranged so as to be located on a first reference axis extending in the longitudinal direction of a vehicle. A reflecting surface of the reflector is split into a plurality of reflection regions. At least one of the plurality of reflection regions, in the plan view of the lamp, are constituted as a fan-like reflection region surrounded by a first straight line extending obliquely downward from the first reference axis on the side of the first reference axis opposite the segment light source in the right and left directions, and a second straight line extending immediately downward from the first reference axis. The fan-like reflection region is constituted with a curved surface that deflects, diffuses, or reflects the light from the segment light source in a direction orthogonal to the first straight line, with a paraboloid of revolution that uses the first predetermined point as a focal point, and uses the first reference axis as a center axis formed as a reference plane, and is configured so as to form the oblique cut-off line that rises obliquely with respect to the horizontal direction by the deflected, diffused, or reflected light from the fan-like reflection region. Thus, in one or more embodiments, the following operation effects can be obtained.

The center axis of the paraboloid of revolution that constitutes the reference plane of the fan-like reflection region is constituted as a first reference axis that uses a first predetermined point located at the front end edge of the segment light source at end edges thereof in the right and left directions as a focal point, and extends in the longitudinal direction of a vehicle so as to pass through the first predetermined point. Thus, if the fan-like reflection region keeps the above reference plane, all light source images of the segment light source formed on a virtual vertical screen arranged ahead of the lamp by the reflected light from individual points in the fan-like reflection region are formed in the positions of the first reference axis opposite the segment light source in the right and left directions, and the upper end edge of each of the light source images is formed so as to extend in an angular direction between a direction orthogonal to the first straight line and the horizontal direction.

Accordingly, if the fan-like reflection region is constituted with a curved surface that deflects, diffuses, or reflects the light from the segment light source in a direction orthogonal to the first straight line L1, with the paraboloid of revolution formed as a reference plane, the deflected, diffused, or reflected light from the fan-like reflection region can be deflected or diffused so as not to stick out upward from the oblique cut-off line, and thereby the oblique cut-off line will be able to be formed clearly.

Moreover, because a light source image of the segment light source formed by the reflected light from a position apart from the first reference axis in the fan-like reflection region is small, and the light source image becomes gradually large as the reflection position approaches the first reference axis, the luminous intensity distribution of a light distribution pattern just below the oblique cut-off line can be set such that luminous intensity increases as it approaches the oblique cut-off line, and thereby the visibility in a remote region on a road surface ahead of a vehicle can be increased.

As described above, according to one or more embodiments of the invention, in the vehicle headlamp comprising a reflector configured to forward reflect the light from a segment light source extending in a vehicle width direction such that a light distribution pattern is formed having a cut-off line at an upper end thereof, the oblique cut-off line can be formed clearly, and the luminous intensity distribution of a light distribution pattern just below the oblique cut-off line can be made as desired.

In the above configuration, if the segment light source is constituted as a pseudo-light source that emits light in a laterally long, substantially rectangular shape in the plan view of the lamp, and the pseudo-light source is formed by arranging an optical member above a light-shielding member where a laterally long rectangular slit is formed, and by making the light from a predetermined actual light source converge into the position of the slit via the optical member, the segment light source can be constituted as a pseudo-light source having a clear outline, and thereby, the oblique cut-off line can be formed more clearly.

In one or more embodiments, the concrete configuration of the "optical member" is not particularly limited. For example, it is possible to adopt a reflector, a lens, etc. Further, in one or more embodiments, the concrete configuration of the "actual light source" is also not particularly limited.

In one or more embodiments, if the fan-like reflection region is split into a plurality of small reflection regions, it is possible to control deflection or diffusion of the reflected light for each of the small reflection regions, and it is thereby possible to finely control the luminous intensity distribution of the light distribution pattern just below the oblique cut-off line.

In one or more embodiments, if the belt-like reflection region of the reflecting surface of the reflector that is adjacent to the fan-like reflection region in the position just below the segment light source is constituted with a curved surface that deflects, diffuses, or reflects the light from the pseudo-light source in the horizontal direction, with a paraboloid of revolution that uses a second predetermined point that is located at a front end edge of the segment light source in its middle position in the right and left directions as a focal point, and uses a second reference axis extending in the longitudinal direction of a vehicle so as to pass through the second predetermined point as a center axis formed as a reference plane, and is configured so as to form the horizontal cut-off line by the deflected, diffused, or reflected light from the belt-like reflection region, the following operation effects can be obtained.

The center axis of the paraboloid of revolution that constitutes the reference plane of the belt-like reflection region is constituted as a second reference axis that uses a second predetermined point located at the front end edge of the segment light source in its middle position in the right and left directions as a focal point, and extends in the longitudinal direction of a vehicle so as to pass through the second predetermined point. Thus, if the belt-like reflection region keeps the above reference plane, all light source images of the segment light source formed on a virtual vertical screen arranged ahead of the lamp by the reflected light from individual points in the belt-like reflection region are formed so as to straddle the second reference axis in the right and left directions, and the upper end edge of each of the light source images is formed so as to extend the horizontal direction.

Accordingly, if the belt-like reflection region is constituted with a curved surface that deflects, diffuses, or reflects the light from the segment light source in the horizontal direction, with the paraboloid of revolution formed as a reference plane, the deflected, diffused, or reflected light from the belt-like reflection region can be deflected or diffused so as not to stick out upward from the horizontal cut-off line, and thereby the horizontal cut-off line will be able to be formed clearly.

Moreover, because a light source image of the segment light source formed by the reflected light from a position apart from the second reference axis in the belt-like reflection region is small, and the light source image becomes gradually large as the reflection position approaches the second reference axis, the luminous intensity distribution of a light distribution pattern just below the horizontal cut-off line can be set such that luminous intensity increases as it approaches the horizontal cut-off line. Thereby, in cooperation with a light distribution pattern formed by the reflected light from the fan-like reflection region, the visibility in a remote region on a road surface ahead of a vehicle can be further increased.

In one or more embodiments, the "middle position in the right and left directions" may be a center position in the right and left directions, and may be a position that deviates from the center position in the right and left directions.

In one or more embodiments, if the reflection region of the plurality of reflection regions adjacent to the side of the fan-like reflection region opposite the belt-like reflection region is constituted with a parabolic cylindrical surface that uses a third reference axis that passes through a third predetermined point located at a front end edge of the segment light source at end edges thereof in the right and left directions, and extends obliquely forward of the first predetermined point with respect to the vehicle width direction as a focal line, and the reflection region adjacent to the side of the belt-like reflection region opposite the fan-like reflection region is constituted with a parabolic cylindrical surface that uses a fourth reference axis that passes through a first predetermined point, and extends obliquely forward of the third predetermined point with respect to the vehicle width direction as a focal line, laterally long light distribution patterns with little unevenness in light distribution can be formed in positions nearer to the front of a vehicle by the reflected light from the two reflection regions so as not to stick out upward from the horizontal cut-off line, and thereby, the brightness around the light distribution patterns formed by the reflected light from the fan-like reflection region and the belt-like reflection region can be reinforced effectively.

Other aspects and advantages of the invention will be apparent from the following description, the drawings and the claims.

BRIEF DESCRIPTION OF THE DRAWINGS

FIGS. 5(*a*) to 5(*e*) are views for explaining the process of forming light distribution patterns that constitute portions of the above light distribution pattern for low beams.

DETAILED DESCRIPTION OF THE EXEMPLARY EMBODIMENTS

Hereinafter embodiments of the invention will be described with reference to the accompanying drawings.

Figure 1:
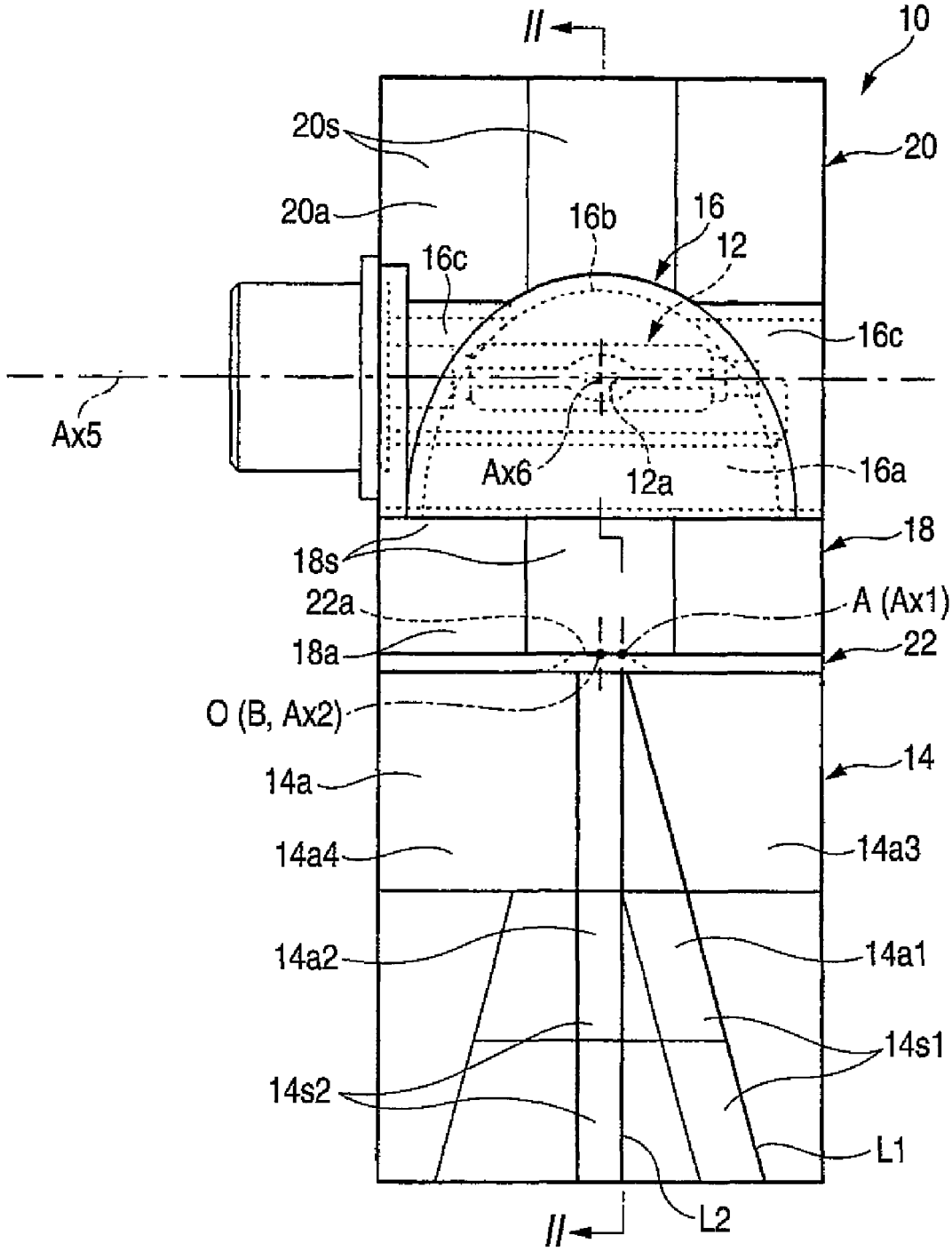
FIG. 1 is a front view showing a vehicle headlamp according to one embodiment of the invention.
Figure 2:
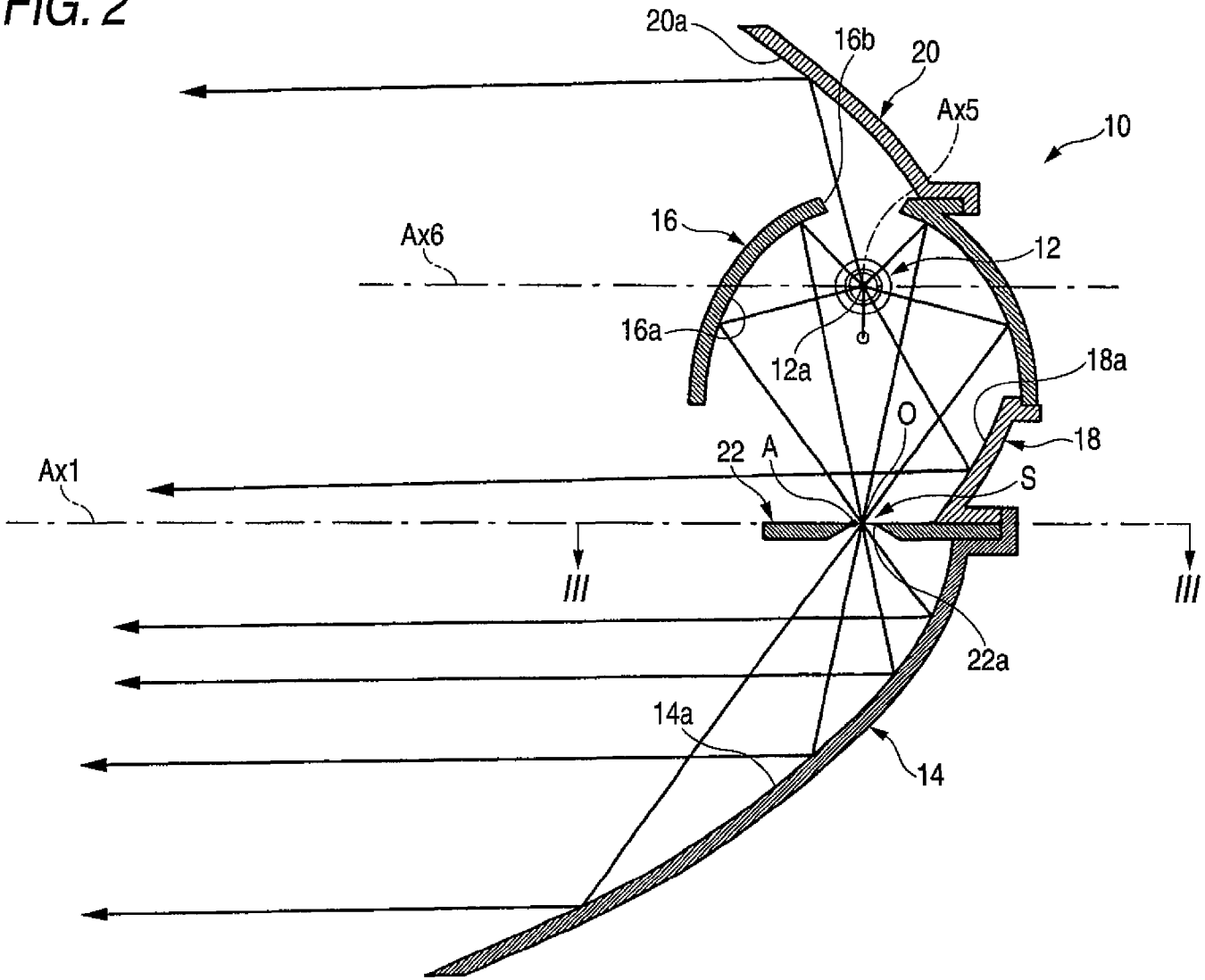
FIG. 2 is a sectional view taken along the line II-II of FIG. 1.
Figure 3:
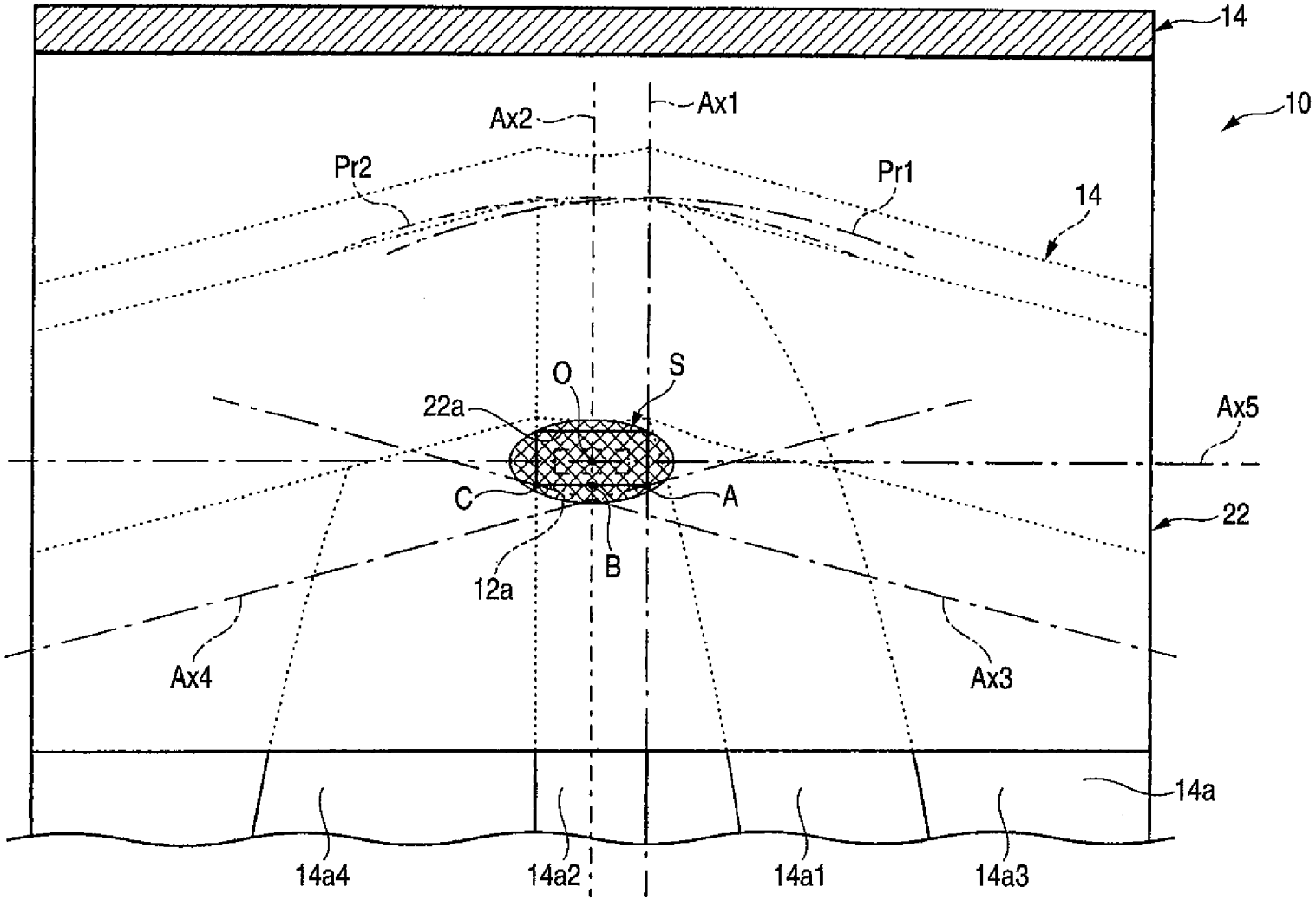
FIG. 3 is a detailed sectional view taken along the line III-III of FIG. 2.

FIG. 1 is a front view showing a vehicle headlamp according to one embodiment of the invention, and FIG. 2 is a detailed sectional view taken along the line II-II. Further, FIG. 3 is a detailed sectional view taken along the line III-III of FIG. 2.

As shown in these drawings, the vehicle headlamp 10 according to the present embodiment is constituted as a lamp unit that performs light irradiation for forming a light distribution pattern for low beams. The vehicle headlamp is assembled into a lamp body that is not shown.

The vehicle headlamp 10 includes a light source bulb 12, a first reflector 14, a second reflector 16, a third reflector 18, a fourth reflector 20, and a light-shielding member 22, and has a vertically long rectangular outer shape in the plan view of the lamp.

The bulb 12 is a discharge bulb, such as, a metal halide bulb, that uses a discharge light-emitting part as a light source 12*a*, and the light source 12*a* is constituted as a segment light source extending along a bulb center axis Ax5 extending in the vehicle width direction.

The second reflector 16 has a reflecting surface 16*a* including an ellipsoid of revolution that uses the center position between discharge electrodes on the bulb center axis Ax5 as a first focal point, and uses a point O located just below the first focal point as a second focal point. In this case, the reflecting surface 16*a* is formed so as to cover the light source 12*a* substantially in the shape of a dome from above, and the light from the light source 12*a* is reflected as the light to be converged into the point O.

However, an opening 16*b* is formed at an upper end of the second reflector 16, and the light from the light source 12*a* is emitted upward of the second reflector 16 via the opening 16*b*. In addition, even if the reflecting surface 16*a* is formed to the position just above the light source 12*a*, the light reflected in the position just above the light source returns to the light source bulb 12, so that exact control cannot be made. Thus, by forming the opening 16*b*, the light that is directed from the light source 12*a* to the position just above the light source can be more effectively utilized.

A half tubular portion 16*c* is formed so as to extend to both the right and left sides of a main body of the second reflector 16, and the light source bulb 12 is fixed and supported at a right end ("left end" in the front view of the lamp; the same hereinafter) of the half tubular portion 16*c*.

The fourth reflector 20 is fixed to and supported by the second reflector 16 on the rear side of the opening 16*b*, in a state of being arranged so as to be adjacent to an upper portion of the second reflector 16, and the light from the light source 12*a* that is directed upward via the opening 16*b* of the second reflector 16 is reflected forward.

The reflecting surface 20*a* of the fourth reflector 20 includes a plurality of diffusing and reflecting elements 20*s* in which a paraboloid of revolution that uses the center position between the discharge electrodes on the bulb center axis Ax5 as a focal point and uses a center axis Ax6 extending in the longitudinal direction of a vehicle through the center position as a center axis is formed as a reference plane, and the light from the light source 12*a* is diffused and reflected slightly downward towards the front and in the right and left directions by each of the diffusing and reflecting elements 20*s*.

The third reflector 18 is fixed to and supported by the second reflector 16 arranged so as to be adjacent to a lower portion of the second reflector 16, and the light that is directed obliquely downward and rearward from the light source 12*a* is reflected forward.

A reflecting surface 18*a* of the fourth reflector 18 includes a plurality of diffusing and reflecting elements 18*s* in which a paraboloid of revolution that uses the center position between the discharge electrodes on the bulb center axis Ax5 as a focal point and uses the center axis Ax6 as a center axis is formed as a reference plane, and the light from the light source 12*a* that is directed obliquely downward and rearward is diffused and reflected slightly downward towards the front and in the right and left directions by each of the diffusing and reflecting elements 18*s*.

The light-shielding member 22 is a plate-like member that is horizontally arranged so as to be adjacent to a lower portion of the third reflector 18, and is fixed to and supported by the third reflector 18.

The top face of the light-shielding member 22 extends along a horizontal plane including the point O (that is, the second focal point of the ellipsoid of revolution constituting the reflecting surface 16*a* of the second reflector 16). Also, a laterally long rectangular slit 22*a* surrounding the point O is formed in the light-shielding member 22. The slit 22*a* has a rectangular shape that is slightly larger than the light source 12*a*, with a point that is located slightly behind the point O in plan view as a center.

A shaded portion shown in an elliptical shape in FIG. 3 indicates a region where the light from the light source 12*a* reflected by the second reflector 16 enters the top face of the light-shielding member 22 as convergent light. The slit 22*a* is formed such that a front end of both end edges thereof in the right and left directions is included in the region and a rear end of both the end edges thereof in the right and left directions is inscribed to the borderline of the region.

The slit 22*a* is formed so as to be widened in the shape of a truncated pyramid from the top face of the light-shielding member 22 towards the bottom face thereof, and thereby, the reflected light from the second reflector 16 passing through the slit 22*a* is shielded by the peripheral wall surface of the slit 22*a*.

The first reflector 14 is arranged so as to be adjacent to a lower portion of the light-shielding member 22, and the reflected light from the second reflector 16 that goes downward via the slit 22*a* is reflected forward. That is, using the slit 22*a* as a pseudo-light source S that emits light in a laterally long rectangular shape in the plan view of the lamp, the first reflector 14 is configured to reflect the light from the pseudo-light source S. Also, the first reflector 14 is fixed to and supported by the third reflector 18 so as to pinch the light-shielding member 22.

A reflecting surface 14*a* of the first reflector 14 is split into four reflection regions, i.e., a fan-like reflection region 14*a*1, a belt-like reflection region 14*a*2, a left reflection region 14*a*3, and a right reflection region 14*a*4.

The fan-like reflection region 14*a*1 is constituted as a fan-like region that is surrounded by a first straight line L1 extending obliquely in the lower left direction from the first reference axis Ax1 and a second straight line L2 extending immediately downward from the first reference line Ax1, on the left side (that is, on the side of the first reference axis Ax1 opposite the pseudo-light source S in the right and left directions) of the first reference axis Ax1 extending in the longitudinal direction of a vehicle so as to pass through the left end edge of the pseudo-light source S, in the plan view of the lamp. In this case, the opening angle of the first straight line L1 with respect to the second straight line L2 is set to 15°.

The fan-like reflection region 14*a*1 is constituted with a curved surface that deflects, diffuses, or reflects the light from the pseudo-light source S in a direction orthogonal to the first straight line L1, with a paraboloid of revolution that uses a first predetermined point A that is located at a front left end edge of the pseudo-light source S as a focal point, and uses a first reference axis Ax1 as a center axis formed as a reference plane. The fan-like reflection region 14*a*1 is split into a plurality of small reflection regions 14*s*1.

The belt-like reflection region 14*a*2 is constituted as a vertically long belt-like reflection region that is located just below the pseudo-light source S so as to be adjacent to the fan-like reflection region 14*a*1 in the plan view of the lamp.

The belt-like reflection region 14*a*2 is constituted with a curved surface that deflects, diffuses, or reflects the light from the pseudo-light source S in the horizontal direction, with a paraboloid of revolution that uses a second predetermined point B that is located at a front end edge of the pseudo-light source S in its middle position in the right and left directions as a focal point, and uses a second reference axis Ax2 extending in the longitudinal direction of a vehicle so as to pass through the second predetermined point B as a center axis formed as a reference plane. The belt-like reflection region 14*a*2 is split into a plurality of small reflection regions 14*s*2.

The left reflection region 14*a*3 is a reflection region adjacent to the left side of the fan-like reflection region 14*a*1, and is constituted with a parabolic cylindrical surface. In this case, the parabolic cylindrical surface is formed passing through a third predetermined point C that is located at a front right end edge of the pseudo-light source S, and using a third reference axis Ax3 extending obliquely forward of the first predetermined point A with respect to the vehicle width direction as a focal line, and the axis of a parabola that constitutes the vertical section of the parabolic cylindrical surface is set to extend horizontally. In that case, the direction of the third reference axis Ax3 is set to extend obliquely in the front left direction at an opening angle of about 15° to the vehicle width direction.

The left reflection region 14*a*4 is a reflection region adjacent to the right side of the belt-like reflection region 14*a*2, and is constituted with a parabolic cylindrical surface. In that case, the parabolic cylindrical surface is formed passing through the third predetermined point A, and using a fourth reference axis Ax3 extending obliquely forward of the third predetermined point C with respect to the vehicle width direction as a focal line, and the axis of a parabola that constitutes the vertical section of the parabolic cylindrical surface is set to extend horizontally. In this case, the direction of the fourth reference axis Ax4 is set to extend obliquely in the front right direction at an opening angle of about 15° to the vehicle width direction.

At the stage where aiming adjustment is completed, the vehicle headlamp 10 according to one or more embodiments is arranged in a state where the first reference axis Ax1, the second reference axis Ax2 and the axis Ax6 have extended downward at about 0.5 to 0.6° with respect to the longitudinal direction of a vehicle.

Figure 4:
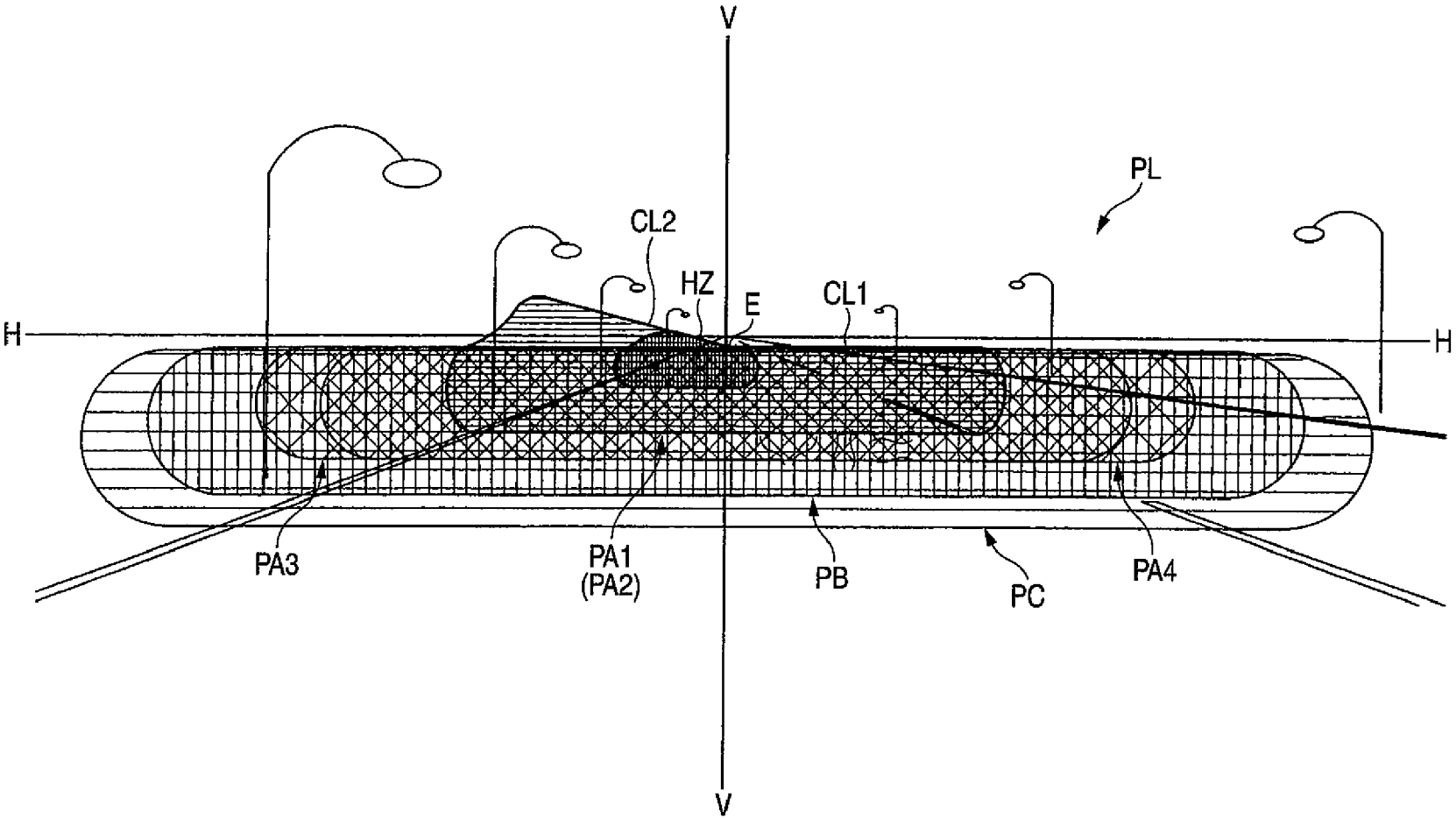
FIG. 4 is a perspective view showing a light distribution pattern for low beams formed on a virtual vertical screen, which is arranged in the position of 25 m ahead of the lamp, by the light radiated forward from the vehicle headlamp.

FIG. 4 is a perspective view showing a light distribution pattern for low beams formed on a virtual vertical screens which is arranged in the position of 25 m ahead of the lamp, by the light radiated forward from the vehicle headlamp 10.

As shown in this drawing, a light distribution pattern PL for low beams is a light distribution pattern for low beams of left light distribution, and has horizontal and oblique cut-off lines CL1 and CL2 at its upper end edge. An elbow point E that is the point of intersection between both the cut-off lines CL1 and CL2 is located about 0.5 to 0.6° lower than H-V that is a vanishing point in the frontal direction of the lamp. In this light distribution pattern PL for low beams, a hot zone HZ that is a high luminous-intensity region is formed so as to surround the elbow point E nearer to the left side.

In this case, as for the horizontal and oblique cut-off lines CL1 and CL2, a right opposite lane portion is formed as the horizontal cut-off line CL1 with a Line V-V that is a vertical line passing through H-V as a boundary, and a left self-lane portion is formed as the oblique cut-off line CL2 that rises obliquely (specifically rises at an angle of 15°) with respect to the horizontal cut-off line CL1.

The light distribution pattern PL for low beams is constituted as a synthetic light distribution pattern of six light distribution patterns PA1, PA2, PA3, PA4, PB, and PC.

Among them, four light distribution patterns PA1, PA2, PA3, and PA4 are light distribution patterns formed by the light from the light source 12*a* reflected by the reflecting surface 14*a* of the first reflector 14. Specifically, the light distribution pattern PA1 is formed by the reflected light from the fan-like reflection region 14*a*1, the light distribution pattern PA2 is formed by the reflected light from the belt-like reflection region 14*a*2, the light distribution pattern PA3 is formed by the reflected light from the left reflection region 14*a*3, and the light distribution pattern PA4 is formed by the reflected light from the right reflection region 14*a*4.

Further, the light distribution pattern PB is formed by the reflected light from the third reflector 18, and the light distribution pattern PC is formed by the reflected light from the fourth reflector 20.

In that case, the light distribution patterns PA1 and PA2 are light distribution patterns whose right-and-left diffusion angle is relatively small, and the horizontal and oblique cut-off lines CL1 and CL2 are formed by the upper end edges of the light distribution patterns.

In addition, the light distribution patterns PA1 and PA2 will be described in detail later.

The light distribution patterns PA3 and PA4 are formed as light distribution patterns that are greater in right-and-left diffusion angle than the light distribution patterns PA1 and PA2. The upper end edge of each of the light distribution patterns PA3 and PA4 is located at almost the same height as the horizontal cut-off line CL1.

In this case, because the light distribution pattern PA3 is formed by the reflected light from the left reflection region 14*a*3 that is constituted with a parabolic cylindrical surface, it becomes a light distribution pattern with large right-and-left diffusion angle. However, because the parabolic cylindrical surface uses the third reference axis Ax3 extending obliquely in the front left direction with respect to the vehicle width direction as a focal line, the formation position of the light distribution pattern is displaced nearer to the right side (that is, nearer to the Line V-V) as compared with a case where the focal line extends in the vehicle width direction.

On the other hand, because the light distribution pattern PA4 is formed by the reflected light from the right reflection region 14*a*4 that is constituted with a parabolic cylindrical surface, it becomes a light distribution pattern with large right-and-left diffusion angle. However, because the parabolic cylindrical surface uses the fourth reference axis Ax4 extending obliquely in the front right direction with respect to the vehicle width direction as a focal line, the formation position of the light distribution pattern is displaced nearer to the left side (that is, nearer to the Line V-V) as compared with a case where the focal line extends in the vehicle width direction.

The light distribution patterns PB and PC are formed as light distribution patterns whose right and left diffusion angle is still greater than the light distribution patterns PA3 and PA4. In this case, the value of the downward deflection angle of each of the diffusing and reflecting elements 18*s* and 20*s* that constitute the reflecting surfaces 18*a* and 20*a* of the third and fourth reflectors 18 and 20 is set so that the upper end edge of each of the light distribution patterns PB and PC may be located at almost the same height as the horizontal cut-off line CL1.

FIGS. 5(*a*) to 5(*e*) are views for explaining the process of forming the light distribution patterns PA1 and PA2.

A light distribution pattern PA1*o* shown in FIG. 5(*a*) is a light distribution pattern formed by the reflected light from the fan-like reflection region 14*a*1 if the fan-like reflection region 14*a*1 keeps the above reference plane (that is, the paraboloid of revolution that uses the first reference axis Ax1 as a center axis), and is constituted as a synthetic light distribution pattern of five light distribution patterns Pao, Pbo, Pco, Pdo, and Peo.

Each of the light distribution patterns Pao, Pbo, Pco, Pdo, and Peo is a light distribution pattern formed by the reflected light from each of the five small reflection regions a, b, c, d, and e that constitute the fan-like reflection region 14*a*1 shown in FIG. 5(*e*).

Each of the light distribution pattern Pao, Pbo, Pco, Pdo, and Peo is formed on the left side of the Line V-V. This is based on the following fact: all light source images of the pseudo-light source S formed on the above virtual vertical screen by the reflected light from each point in the fan-like reflection region 14*a*1 are formed in the left position of the Line V-V (that is, on the side of the first reference axis Ax1 opposite the pseudo-light source S in the right-and-left directions), and the upper end edge of each of the light source images is formed so as to extend in an angular direction between a direction (that is, an oblique direction that rises at an angle of 15° with respect to the horizontal direction) orthogonal to the first straight line L1 and the horizontal direction.

In this case, among these five light distribution patterns Pao, Pbo, Pco, Pdo, and Peo, the light distribution patterns Pao and Pbo formed by the reflected light from the small reflection regions a and b located at a lower stage that is separated from the first reference axis Ax1 are formed as small light patterns, the light distribution patterns Pco and Pdo formed by the reflected light from the small reflection regions c and d located at a middle stage are formed as slightly larger light distribution patterns, and the light distribution pattern Peo formed by the reflected light from the small reflection region e located at an upper stage is formed as a large light distribution pattern. Further, the light distribution patterns Pbo, Pdo, and Peo formed by the reflected light from the reflection regions b, d, and e along the first straight line L1 are formed so that an upper end edge thereof may extend along the oblique cut-off line CL2.

The light distribution pattern PA1 shown in FIG. 5(*b*) is an actual light distribution pattern formed by the reflected light from the fan-like reflection region 14*a*1.

Because the fan-like reflection region 14*a*1 is constituted with a curved surface that deflects, diffuses, or reflects the light from the pseudo-light source S in a direction orthogonal to the first straight line L1, with a paraboloid of revolution that uses the first predetermined point A as a focal point, and uses the first reference axis Ax1 as a center axis formed as a reference plane, the oblique cut-off line CL2 is formed by the upper end edge of the light distribution pattern PA1.

In this case, the light distribution patterns Pa and Pb formed by the reflected light from the small reflection regions a and b located at a lower stage are formed as light distribution patterns that diffuse the small light distribution patterns Pao and Pbo a little in a lower right direction and diffuses them a little in an upper left direction. The light distribution patterns Pc and Pd formed by the reflected light from the small reflection regions e and d located at a middle stage are formed as light distribution patterns that diffuse the slightly larger light distribution patterns Peo and Pdo a little in a lower right direction and diffuse them a somewhat in an upper left direction. The light distribution pattern Pe formed by the reflected light from the small reflection region e located at an upper stage is formed as a large light distribution pattern that diffuses the large light distribution pattern Peo a somewhat in an lower right direction and diffuses it somewhat largely in an upper left direction.

Accordingly, the light distribution pattern PA1 has the luminous intensity distribution that is brightest in a position close to the oblique cut-off line CL2 and close to the elbow point E and becomes gradually dark as it goes away therefrom.

A light distribution pattern PA2*o* shown in FIG. 5(*c*) is a light distribution pattern formed by the reflected light from the belt-like reflection region 14*a*2 if the belt-like reflection region 14*a*2 keeps the above reference plane (that is, the paraboloid of revolution that uses the second reference axis Ax2 as a center axis), and is constituted as a synthetic light distribution pattern of three light distribution patterns Pfo, Pgo, and Pho.

Each of the light distribution patterns Pfo, Pgo, and Pho is a light distribution pattern formed by the reflected light from each of the three small reflection regions f, g, and b that constitute the belt-like reflection region 14*a*2 shown in FIG. 5(*e*).

Each of the light distribution patterns Pfo, Pgo, and Pfo is formed as a laterally long light distribution pattern that equally straddles the Line V-V to the right and left so that its upper end edge may extend along the oblique cut-off line CL2. This is based on the following fact: light source images of the pseudo-light source S formed on the above virtual vertical screen by the reflected light from individual points in the belt-like reflection region 14*a*2 are formed as laterally long light source images that equally straddle the line V-V to the right and left, and the upper end edge of each of the light source images extends so as to extend in a direction (that is, horizontal direction) orthogonal to the second straight line L1.

In this case, among these three light distribution patterns Pfo, Pgo, and Pho, the light distribution pattern Pfo formed by the reflected light from the small reflection region f located at a lower stage that is separated from the second reference axis Ax2 is formed as a small light pattern, the light distribution pattern Pgo formed by the reflected light from the small reflection region g at a middle stage is formed as a slightly larger light distribution pattern, and the light distribution pattern Pho formed by the reflected light from the small reflection region h located at an upper stage is formed as a large light distribution pattern.

The light distribution pattern PA2 shown in FIG. 5(*d*) is an actual light distribution pattern formed by the reflected light from the belt-like reflection region 14*a*2.

Because the belt-like reflection region 14*a*2 is constituted with a curved surface that deflects, diffuses, or reflects the light from the pseudo-light source S in a direction orthogonal to the second straight line L2, with a paraboloid of revolution that uses the second predetermined point B as a focal point, and uses the second reference axis Ax2 as a center axis formed as a reference plane, the horizontal cut-off line CL1 is formed by the upper end edge of the light distribution pattern PA2.

In that case, the light distribution pattern Pf formed by the reflected light from the small reflection region f located at a lower stage is formed as a light distribution pattern that diffuses the small light distribution pattern Pfo a little to both the right and left. The light distribution pattern Pg formed by the reflected light from the small reflection region g located at a middle stage is formed as alight distribution pattern that diffuses the slightly larger light distribution pattern Pgo a somewhat to both the right and left. The light distribution pattern Ph formed by the reflected light from the small reflection region h located at an upper stage is formed as a light distribution pattern that diffuses the large light distribution pattern Pho somewhat largely to both the right and left.

Accordingly, the light distribution pattern PA2 has the luminous intensity distribution that is brightest in a position close to the horizontal cut-off line CL1 and close to the elbow point E and becomes gradually dark as it goes away therefrom.

As described in detail above, the vehicle headlamp 10 according to one or more embodiments is configured so as to forward reflect the light from a pseudo-light source S serving as a segment light source extending in a vehicle width direction by means of a first reflector 14, thereby forming a light distribution pattern PL for low beams that has cut-off lines CL1 and CL2 at its upper end. In this case, the pseudo-light source S is arranged such that a first predetermined point A located at the front left end edge of the pseudo-light source S in a plan view of the lamp is located on a first reference axis Ax1 extending in the longitudinal direction of a vehicle. Further, a reflecting surface 14*a* of the first reflector 14 is split into four reflection regions 14*a*1, 14*a*2, 14*a*3, and 14*a*4. Some of the four reflection regions, in the plan view of the lamp, are constituted as a fan-like reflection region 14*a*1 surrounded by a first straight line L1 extending obliquely in the lower left direction from the first reference axis Axe on the side of the first reference axis Ax1 opposite the pseudo-light source S in right and left directions, and a second straight line L2 extending immediately downward from the first reference axis Ax1. Also, the fan-like reflection region 14*a*1 is constituted with a curved surface that deflects, diffuses, or reflects the light from the pseudo-light source S in a direction orthogonal to the first straight line L1, with a paraboloid of revolution that uses the first predetermined point A as a focal point, and uses the first reference axis Ax1 as a center axis formed as a reference plane, and is configured so as to form the oblique cut-off line CL2 that rises obliquely with respect to the horizontal direction by the deflected, diffused or reflected light from the fan-like reflection region 14*a*1. Thus, in one or more embodiments, the following operation effects can be obtained.

Figure 6:
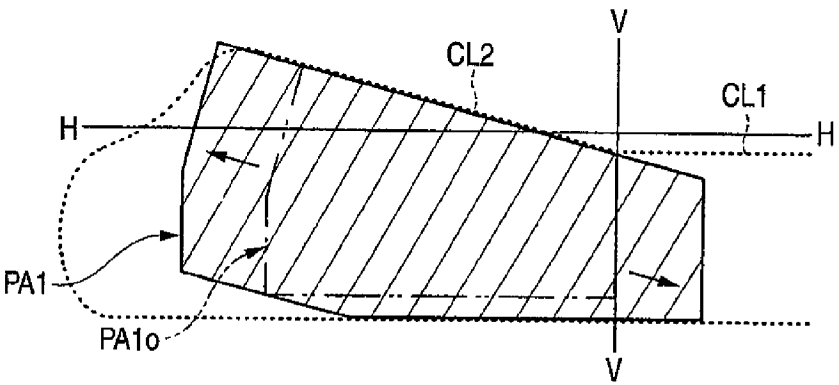
FIGS. 6(*a*) to 6(*d*) are views illustrating the operation of one or more embodiments of the invention.
Figure 6:
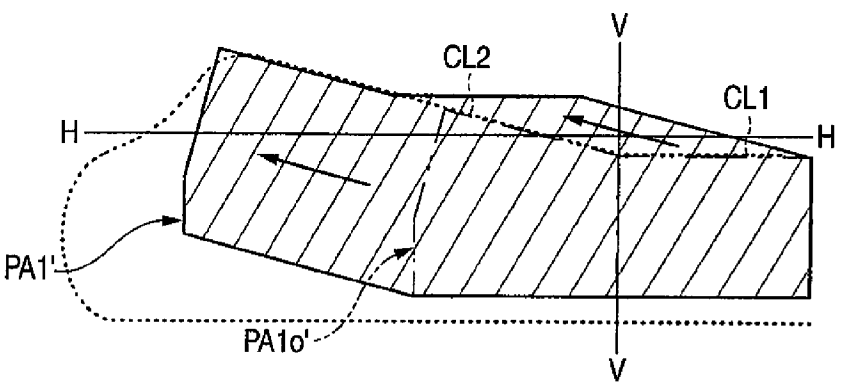
Figure 6:
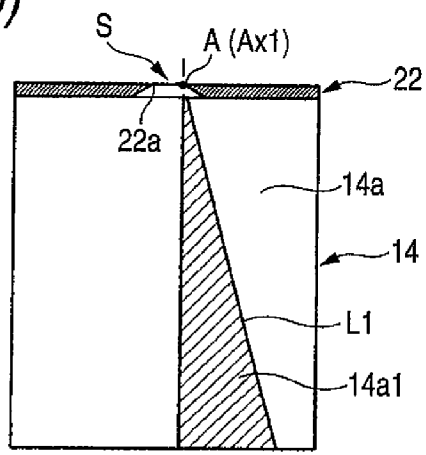
Figure 6:
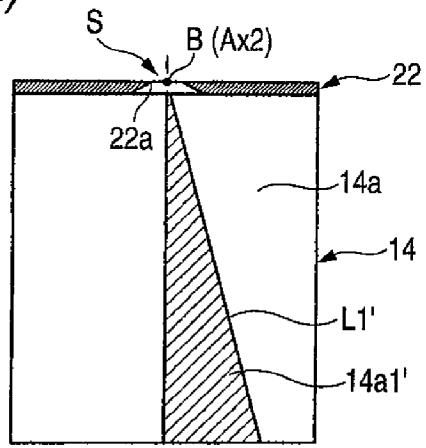

That is, as shown in FIG. 6(*d*), in the case where the center axis of the paraboloid of revolution that constitutes the reference plane of the fan-like reflection region 14*a*1 is constituted as a second reference axis Ax2 that uses a second predetermined point B in the middle position of a front end edge of the pseudo-light source S in the right and left directions as a focal point, and extends in the longitudinal direction of a vehicle so as to pass through the second predetermined point B, if the fan-like reflection region 14*a*1 keeps the above reference plane, light source images of the pseudo-light source S formed on a virtual vertical screen arranged ahead of the lamp by the reflected light from individual points in the fan-like reflection region 14*a*1 are formed so as to straddle the line V-V to the right and left as indicated by two-dot chain lines in FIG. 6(*c*). Accordingly, even if the fan-like reflection region 14*a*1 is constituted with a curved surface that deflects, diffuses, or reflects the light from the pseudo-light source S obliquely in a lower left direction from the second straight line L1, with the paraboloid of revolution formed as a reference plane, as indicated by solid lines in FIG. 6(*c*), the deflected, diffused, or reflected light from the fan-like reflection region 14*a*1 will stick out upward from the oblique cut-off line CL2, and the oblique cut-off line CL2 will not be able to be formed clearly.

In contrast, in one or more embodiments, as shown in FIG. 6(*b*), the center axis of the paraboloid of revolution that constitutes the reference plane of the fan-like reflection region 14*a*1 is constituted as a first reference axis Ax1 that uses a first predetermined point A located at the front left end edge of the pseudo-light source S as a focal point, and extends in the longitudinal direction of a vehicle so as to pass through the first predetermined point A. Thus, if the fan-like reflection region 14*a*1 keeps the above reference plane, all light source images of the pseudo-light source S formed on a virtual vertical screen arranged ahead of the lamp by the reflected light from individual points in the fan-like reflection region 14*a*1 are formed in the positions of the first reference axis Ax1 opposite the pseudo-light source S in the right and left directions as indicated by two-dot chain lines in FIG. 6(*a*), and the upper end edge of each of the light source images is formed so as to extend in an angular direction between a direction orthogonal to the first straight line L1 and the horizontal direction. Accordingly, if the fan-like reflection region 14*a*1 is constituted with a curved surface that deflects, diffuses, or reflects the light from the pseudo-light source S in a direction orthogonal to the first straight line L1, with the paraboloid of revolution being as a reference plane, as indicated by solid lines in FIG. 6(*a*), the deflected, diffused, or reflected light from the fan-like reflection region 14*a*1 can be deflected or diffused so as not to stick out upward from the oblique cut-off line CL2, and thereby the oblique cut-off line CL2 will be able to be formed clearly.

Moreover, because a light source image of the pseudo-light source S formed by the reflected light from a position apart from the first reference axis Ax1 in the fan-like reflection region 14*a*1 is small, and the light source image becomes gradually large as the reflection position approaches the first reference axis Ax1, the luminous intensity distribution of a light distribution pattern PA1 just below the oblique cut-off line CL2 can be set such that luminous intensity increases as it approaches the oblique cut-off line CL2, and thereby the visibility in a remote region on a road surface ahead of a vehicle can be increased.

As described above, according to one or more embodiments, in the vehicle headlamp comprising a reflector configured to forward reflect the light from a segment light source extending in a vehicle width direction such that a light distribution pattern is formed having cut-off lines at an upper end thereof, the oblique cut-off line CL2 can be formed clearly, and the luminous intensity distribution of a light distribution pattern PA1 just below the oblique cut-off line CL2 can be made as desired.

Further, in one or more embodiments, the segment light source extending in the vehicle width direction is constituted as a pseudo-light source S that emits light in a laterally long, substantially rectangular shape in the plan view of the lamp, and the pseudo-light source S is formed by arranging a second reflector 16 above a light-shielding member 22 where a laterally long rectangular slit 22*a* is formed, and by making the light from a light source bulb 12 converge into the position of the slit 22*a* via the second reflector 16. Thus, the pseudo-light source S can be constituted as a pseudo-light source having a clear outline, and thereby, the oblique cut-off line CL2 can be formed more clearly.

In this case, since the second reflector 16 has a reflecting surface 16*a* including an ellipsoid of revolution that uses the center position between discharge electrodes on the bulb center axis Ax5 as a first focal point, and uses a point O located just below the first focal point as a second focal point, the light from the light source 12*a* can be made to efficiently converge into the point O, and the luminous flux of the pseudo-light source S can be increased sufficiently.

Moreover, in one or more embodiments, the fan-like reflection region 14*a*1 is split into a plurality of small reflection region 14*a*1. Thus, it is possible to control deflection or diffusion of the reflected light for each of the small reflection regions 14*a*1, and it is thereby possible to finely control the luminous intensity distribution of the light distribution pattern PA1 just below the oblique cut-off line CL2.

Moreover, in one or more embodiments, the belt-like reflection region 14*a*2 of the reflecting surface 14*a* of the first reflector 14 that is adjacent to the fan-like reflection region 14*a*1 in the position just below the pseudo-light source S is constituted with a curved surface that deflects, diffuses, or reflects the light from the pseudo-light source S in the horizontal direction, with a paraboloid of revolution that uses a second predetermined point B that is located at a front end edge of the pseudo-light source S in its middle position in the right and left directions as a focal point, and uses a second reference axis Ax2 extending in the longitudinal direction of a vehicle so as to pass through the second predetermined point B as a center axis formed as a reference plane, and is configured so as to form the horizontal cut-off line CL1 by the deflected, diffused, or reflected light from the belt-like reflection region 14*a*2. Thus, the following operation effects can be obtained.

Because the center axis of the paraboloid of revolution that constitutes the reference plane of the belt-like reflection region 14*a*2 is constituted as a second reference-axis Ax2 that uses a second predetermined point B in the middle position of a front end edge of the pseudo-light source S in the right and left directions as a focal point, and extends in the longitudinal direction of a vehicle so as to pass through the second predetermined point B, if the belt-like reflection region 14*a*2 keeps the above reference plane, all light source images of the pseudo-light source S formed on a virtual vertical screen arranged ahead of the lamp by the reflected light from individual points in the belt-like reflection region 14*a*2 are formed so as to straddle the second reference axis Ax2 to the right and left, and are formed so that the upper end edge of each of the light source images may extend in the horizontal direction.

Accordingly, if the belt-like reflection region 14*a*2 is constituted with a curved surface that deflects, diffuses, or reflects the light from the pseudo-light source S in the horizontal direction, with the paraboloid of revolution formed as a reference plane, the deflected, diffused, or reflected light from the belt-like reflection region 14*a*2 can be deflected or diffused so as not to stick out upward from the horizontal cut-off line CL1, and thereby the horizontal cut-off line CL1 will be able to be formed clearly.

Moreover, because a light source image of the pseudo-light source S formed by the reflected light from a position apart from the second reference axis Ax2 in the belt-like reflection region 14*a*2 is small, and the light source image becomes gradually large as the reflection position approaches the second reference axis Ax2, the luminous intensity distribution of a light distribution pattern PA2 just below the horizontal cut-off line CL1 can be set such that luminous intensity increases as it approaches the horizontal cut-off line C1. Thereby, in cooperation with a light distribution pattern formed by the reflected light from the fan-like reflection region 14*a*1, the visibility in a remote region on a road surface ahead of a vehicle can be further increased.

Further, in one or more embodiments, the center axis of the paraboloid of revolution that constitutes the reference plane of the belt-like reflection region 14*a*2 is constituted with the second reference axis Ax2 that uses a second predetermined point B that is located at a front end edge of the pseudo-light source S in its middle position in the right and left directions as a focal point, and uses a second reference axis Ax2 extending in the longitudinal direction of a vehicle so as to pass through the second predetermined point B as a center axis. Thus, it is possible to easily form the light distribution pattern PA2 as a laterally long light distribution pattern that is diffused equally in the right and left directions with the line V-V as a center.

Moreover, in one or more embodiments, the left reflection region 14*a*3 adjacent to the side of the fan-like reflection region 14*a*1 opposite the belt-like reflection region 14*a*2 is constituted with a parabolic cylindrical surface that uses a third reference axis Ax3 that passes through a third predetermined point C located at a front right end edge of the pseudo-light source S, and extends obliquely forward of the first predetermined point A with respect to the vehicle width direction as a focal line. Also, the right reflection region 14*a*4 adjacent to the side of the belt-like reflection region 14*a*2 opposite the fan-like reflection region 14*a*1 is constituted with a parabolic cylindrical surface that uses a fourth reference axis Ax4 that passes through the first predetermined point A, and extends obliquely forward of the third predetermined point C with respect to the vehicle width direction as a focal line. Thus, laterally long light distribution patterns PA3 and PA4 with little unevenness in light distribution can be formed in positions nearer to the front of a vehicle by the reflected light from the left reflection region 14*a*3 and the right reflection region 14*a*4 so as not to stick out upward from the horizontal cut-off line CL1, and thereby, the brightness around the light distribution patterns PA1 and PA2 formed by the reflected light from the fan-like reflection region 14*a*1 and the belt-like reflection region 14*a*2 can be reinforced effectively.

In addition, although description has been made in the above embodiments that the center axis of a paraboloid of revolution that constitutes the reference plane of the belt-like reflection region 14*a*2 passes through the middle position of the pseudo-light source S in the right and left directions, it is also possible to pass through a position that deviates slightly to the right and left from the second predetermined point B. In such a case, it is possible to easily form the light distribution pattern PA2 as a laterally long light distribution pattern that is diffused unequally in the right and left directions with respect to the line V-V.

Further, although description has been made in the above embodiments that the pseudo-light source S is adopted as a segment light source extending in the vehicle width direction, it is also natural to constitute the segment light source with an actual light source.

While description has been made in connection with embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

REFERENCE NUMERALS

10: VEHICLE HEADLAMP
12: LIGHT SOURCE BULB
12*a*: LIGHT SOURCE
14: FIRST REFLECTOR
14*a*, 16*a*, 18*a*, 20*a*: REFLECTING SURFACE
14*a*1, 14*a*1': FAN-LIKE REFLECTION REGION
14*a*2: BELT-LIKE REFLECTION REGION
14*a*3: LEFT REFLECTION REGION
14*a*4: RIGHT REFLECTION REGION
14*s*1, 14*s*2: SMALL REFLECTION REGION
16: SECOND REFLECTOR
16*b*: OPENING
16*c*: SEMI-TUBULAR PORTION
18: THIRD REFLECTOR
18*s*, 20*s*: DIFFUSING AND REFLECTING ELEMENT
20: FOURTH REFLECTOR
22: LIGHT-SHIELDING MEMBER
22*a*: SLIT
A: FIRST PREDETERMINED POINT
Ax1: FIRST REFERENCE AXIS
Ax2: SECOND REFERENCE AXIS
Ax3: THIRD REFERENCE AXIS
Ax4: FOURTH REFERENCE AXIS
Ax5: BULB CENTER AXIS
Ax6: AXIS
a, b, c, d, e, f, g, g, h: REFLECTION REGION
B: SECOND PREDETERMINED POINT
C: THIRD PREDETERMINED POINT
CL1: HORIZONTAL CUT-OFF LINE
CL2: OBLIQUE CUT-OFF LINE
E: ELBOW POINT
HZ: HOT ZONE
L1, L1': FIRST STRAIGHT LINE
L2: SECOND STRAIGHT LINE
O: POINT
PA1, PA1', PA1*o*, PA1*o'*, PA2, PA2*o*, PA3, PA4, PB, PC, Pa, Pao, Pb, Pbo, Pc, Pco, Pd, Pdo, Pe, Peo, Pf, Pfo, Pg, Pgo, Ph, Pho: LIGHT DISTRIBUTION PATTERN
PL: LIGHT DISTRIBUTION PATTERN FOR LOW BEAMS
S: PSEUDO-LIGHT SOURCE

What is claimed is:

1. A vehicle headlamp comprising:

a segment light source extending in a vehicle width direction; and a reflector configured to forward reflect light from the segment light source such that a light distribution pattern is formed that has a cut-off line at an upper end thereof, wherein the segment light source is arranged such that a first predetermined point located at a front end edge of the segment light source at end edges thereof in right and left directions in a plan view of the vehicle headlamp is located on a first reference axis extending in the longitudinal direction of a vehicle containing the vehicle headlamp, wherein a reflecting surface of the reflector is split into a plurality of reflection regions, wherein at least one of the plurality of reflection regions, in the plan a front view of the vehicle headlamp, is constituted as a fan-like reflection region surrounded by a first straight line extending obliquely downward from the first reference axis on the side of the first reference axis opposite the segment light source in the right and left directions, and a second straight line extending immediately downward from the first reference axis, and wherein the fan-like reflection region is constituted with a curved surface that deflects, diffuses, or reflects the light from the segment light source in a direction orthogonal to the first straight line, with a paraboloid of revolution that uses the first predetermined point as a first focal point and uses the first reference axis as a center axis formed as a reference plane so as to form the cut-off line.

2. The vehicle headlamp according to claim 1, wherein the segment light source is constituted as a pseudo-light source that emits light in a laterally long, substantially rectangular shape in the plan view of the vehicle headlamp, and the pseudo-light source is formed by arranging an optical member above a light-shielding member where a laterally long rectangular slit is formed, and making light from a predetermined actual light source converge into a position of the slit via the optical member.

3. The vehicle headlamp according to claim 2, wherein the fan-like reflection region is split into a plurality of reflection regions.

4. The vehicle headlamp according to claim 3, wherein at least another of the plurality of reflection regions is constituted as a belt-like reflection region that is located just below the segment light source so as to be adjacent to the fan-like reflection region, and wherein the belt-like reflection region is constituted with a curved surface that deflects, diffuses, or reflects the light from the segment light source in a horizontal direction, with a paraboloid of revolution that uses a second predetermined point that is located at a front end edge of the segment light source in a middle position in right and left directions as a second focal point and uses a second reference axis extending in the longitudinal direction of a vehicle so as to pass through the second predetermined point as a center axis formed as a reference plane so as to form the cut-off line.

5. The vehicle headlamp according to claim 4, wherein the reflection region of the plurality of reflection regions adjacent to a side of the fan-like reflection region opposite the belt-like reflection region is constituted with a parabolic cylindrical surface that uses a third reference axis that passes through a third predetermined point located at a front end edge of the segment light source at end edges thereof in right and left directions, and extends obliquely forward of the first predetermined point with respect to the vehicle width direction as a focal line, and the reflection region adjacent to a side of the belt-like reflection region opposite the fan-like reflection region is constituted with a parabolic cylindrical surface that uses a fourth reference axis that passes through the first predetermined point, and extends obliquely forward of the third predetermined point with respect to the vehicle width direction as a focal line.

6. The vehicle headlamp according to claim 2, wherein at least another of the plurality of reflection regions is constituted as a belt-like reflection region that is located just below the segment light source so as to be adjacent to the fan-like reflection region, and wherein the belt-like reflection region is constituted with a curved surface that deflects, diffuses, or reflects the light from the segment light source in a horizontal direction, with a paraboloid of revolution that uses a second predetermined point that is located at a front end edge of the segment light source in a middle position in right and left directions as a second focal point and uses a second reference axis extending in the longitudinal direction of a vehicle so as to pass through the second predetermined point as a center axis formed as a reference plane so as to form the cut-off line.

7. The vehicle headlamp according to claim 6, wherein the reflection region of the plurality of reflection regions adjacent to a side of the fan-like reflection region opposite the belt-like reflection region is constituted with a parabolic cylindrical surface that uses a third reference axis that passes through a third predetermined point located at a front end edge of the segment light source at end edges thereof in right and left directions, and extends obliquely forward of the first predetermined point with respect to the vehicle width direction as a focal line, and the reflection region adjacent to a side of the belt-like reflection region opposite the fan-like reflection region is constituted with a parabolic cylindrical surface that uses a fourth reference axis that passes through the first predetermined point, and extends obliquely forward of the third predetermined point with respect to the vehicle width direction as a focal line.

8. The vehicle headlamp according to claim 1, wherein the fan-like reflection region is split into a plurality of reflection regions.

9. The vehicle headlamp according to claim 8, wherein at least another of the plurality of reflection regions is constituted as a belt-like reflection region that is located just below the segment light source so as to be adjacent to the fan-like reflection region, and wherein the belt-like reflection region is constituted with a curved surface that deflects, diffuses, or reflects the light from the segment light source in a horizontal direction, with a paraboloid of revolution that uses a second predetermined point that is located at a front end edge of the segment light source in a middle position in right and left directions as a second focal point and uses a second reference axis extending in the longitudinal direction of a vehicle so as to pass through the second predetermined point as a center axis formed as a reference plane so as to form the cut-off line.

10. The vehicle headlamp according to claim 9, wherein a reflection region of the plurality of reflection regions adjacent to a side of the fan-like reflection region opposite the belt-like reflection region is constituted with a parabolic cylindrical surface that uses a third reference axis that passes through a third predetermined point located at a front end edge of the segment light source at end edges thereof in right and left directions, and extends obliquely forward of the first predetermined point with respect to the vehicle width direction as a focal line, and the reflection region adjacent to a side of the belt-like reflection region opposite the fan-like reflection region is constituted with a parabolic cylindrical surface that uses a fourth reference axis that passes through the first predetermined point, and extends obliquely forward of the third predetermined point with respect to the vehicle width direction as a focal line.

11. The vehicle headlamp according to claim 1, wherein at least another of the plurality of reflection regions is constituted as a belt-like reflection region that is located just below the segment light source so as to be adjacent to the fan-like reflection region, and wherein the belt-like reflection region is constituted with a curved surface that deflects, diffuses, or reflects the light from the segment light source in a horizontal direction, with a paraboloid of revolution that uses a second predetermined point that is located at a front end edge of the segment light source in a middle position in right and left directions as a second focal point and uses a second reference axis extending in the longitudinal direction of the vehicle so as to pass through the second predetermined point as a center axis formed as a reference plane so as to form the cut-off line.

12. The vehicle headlamp according to claim 11, wherein the reflection region of the plurality of reflection regions adjacent to a side of the fan-like reflection region opposite the belt-like reflection region is constituted with a parabolic cylindrical surface that uses a third reference axis that passes through a third predetermined point located at a front end edge of the segment light source at end edges thereof in right and left directions, and extends obliquely forward of the first predetermined point with respect to the vehicle width direction as a focal line, and the reflection region adjacent to a side of the belt-like reflection region opposite the fan-like reflection region is constituted with a parabolic cylindrical surface that uses a fourth reference axis that passes through the first predetermined point, and extends obliquely forward of the third predetermined point with respect to the vehicle width direction as a focal line.

13. A vehicle headlamp comprising:

a segment light source extending in a vehicle width direction; and a reflector configured to forward reflect light from the segment light source such that a light distribution pattern is formed that has a cut-off line at an upper end thereof, wherein the reflector comprises a reflecting surface split into a plurality of reflection regions, wherein the segment light source is arranged such that a first predetermined point located at a front end edge of the segment light source at end edges thereof in right and left directions in a plan view of the vehicle headlamp is located on a first reference axis extending in the longitudinal direction of a vehicle containing the vehicle headlamp, wherein, in a front view of the vehicle headlamp, at least one of the plurality of reflection regions comprises a fan-like reflection region surrounded by:

a first straight line extending obliquely downward from the first reference axis on the side of the first reference axis opposite the segment light source in the right and left directions, and a second straight line extending immediately downward from the first reference axis, and wherein the fan-like reflection region comprises a curved surface that deflects, diffuses, or reflects the light from the segment light source in a direction orthogonal to the first straight line, with a paraboloid of revolution that uses the first predetermined point as a first focal point and uses the first reference axis as a center axis formed as a reference plane.

14. The vehicle headlamp according to claim 13, wherein the segment light source comprises a pseudo-light source that emits light in a laterally long, substantially rectangular shape in the plan view of the vehicle headlamp.

15. The vehicle headlamp according to claim 14, wherein the pseudo-light source comprises:

an optical member arranged above a light-shielding member where a laterally long rectangular slit is formed, and wherein light from a predetermined actual light source converges into the slit via the optical member.

16. The vehicle headlamp according to claim 13, wherein the fan-like reflection region is split into a plurality of reflection regions.

17. The vehicle headlamp according to claim 13, wherein at least another of the plurality of reflection is regions comprises a belt-like reflection region that is located just below the segment light source so as to be adjacent to the fan-like reflection region, and wherein the belt-like reflection region comprises a curved surface that deflects, diffuses, or reflects the light from the segment light source in a horizontal direction, with a paraboloid of revolution that uses a second predetermined point that is located at a front end edge of the segment light source in a middle position in right and left directions as a second focal point and uses a second reference axis extending in the longitudinal direction of a vehicle so as to pass through the second predetermined point as a center axis formed as a reference plane.

18. The vehicle headlamp according to claim 17, wherein the reflection region of the plurality of reflection regions adjacent to a side of the fan-like reflection region opposite the belt-like reflection region comprises a parabolic cylindrical surface that uses a third reference axis that passes through a third predetermined point located at a front end edge of the segment light source at end edges thereof in right and left directions, and extends obliquely forward of the first predetermined point with respect to the vehicle width direction as a focal line, and the reflection region adjacent to a side of the belt-like reflection region opposite the fan-like reflection region comprises a parabolic cylindrical surface that uses a fourth reference axis that passes through the first predetermined point, and extends obliquely forward of the third predetermined point with respect to the vehicle width direction as a focal line.

19. A method of making a vehicle headlamp comprising a segment light source extending in a vehicle width direction and configured to forward reflect light from the segment light source such that a light distribution pattern is formed that has a cut-off line at an upper end thereof comprising:

configuring a reflector to forward reflect light from the segment light source;

splitting a reflecting surface of the reflector into a plurality of reflection regions, arranging the segment light source such that a first predetermined point located at a front end edge of the segment light source at end edges thereof in right and left directions in a plan view of the vehicle headlamp is located on a first reference axis extending in the longitudinal direction of a vehicle containing the vehicle headlamp;

constituting, in a front view of the vehicle headlamp, at least one of the plurality of reflection regions as a fan-like reflection region surrounded by:

a first straight line extending obliquely downward from the first reference axis on the side of the first reference axis opposite the segment light source in the right and left directions, and a second straight line extending immediately downward from the first reference axis, and wherein the fan-like reflection region comprises a curved surface that deflects, diffuses, or reflects the light from the segment light source in a direction orthogonal to the first straight line, with a paraboloid of revolution that uses the first predetermined point as a focal point and uses the first reference axis as a center axis formed as a reference plane.

20. The method according to claim 19, further comprising:

configuring the segment light source as a pseudo-light source that emits light in a laterally long, substantially rectangular shape in the plan view of the vehicle headlamp, and forming the pseudo-light source by:

arranging an optical member above a light-shielding member where a laterally long rectangular slit is formed, and making light from a predetermined actual light source converge into a position of the slit via the optical member.

* * * * *